US007052256B2

(12) United States Patent
Neuhaus

(10) Patent No.: US 7,052,256 B2
(45) Date of Patent: May 30, 2006

(54) SYNCHRONIZED TRANSAXLE HYDRAULIC MOTOR

(75) Inventor: Bernie W. Neuhaus, Glencoe, MN (US)

(73) Assignee: Eaton Corporation, Cleveland, OH (US)

( * ) Notice: Subject to any disclaimer, the term of this patent is extended or adjusted under 35 U.S.C. 154(b) by 121 days.

(21) Appl. No.: 10/766,350

(22) Filed: Jan. 28, 2004

(65) Prior Publication Data

US 2005/0163643 A1 Jul. 28, 2005

(51) Int. Cl.
*F01C 1/02* (2006.01)

(52) U.S. Cl. ..... 418/61.3; 418/186

(58) Field of Classification Search ..... 418/61.3, 418/171, 166, 186, 187
See application file for complete search history.

(56) References Cited

U.S. PATENT DOCUMENTS 1,341,846 A 6/1920 Gollings
2,989,951 A 6/1961 Charlson
3,552,893 A 1/1971 Richardson
3,829,258 A * 8/1974 Easton ..... 418/61.3
3,846,051 A 11/1974 McDermott
4,171,938 A 10/1979 Pahl
4,439,119 A 3/1984 Petersen et al.
4,561,833 A * 12/1985 Minegishi ..... 418/61.3
4,756,676 A * 7/1988 Bernstrom ..... 418/61.3
4,936,094 A * 6/1990 Novacek ..... 418/61.3

* cited by examiner

*Primary Examiner*—Theesa Trieu
(74) *Attorney, Agent, or Firm*—L. J. Kasper

(57) ABSTRACT

A dual shaft gerotor motor (11) of the type comprising a gerotor gear set (13) including an internally-toothed ring member (15) and an externally-toothed star member (17). The motor (11) includes substantially identical first (25) and second (27) motor housing assemblies attached to first (21) and second (22) axially opposite ends of the gerotor gear set (13), and defining first (47) and second (45) fluid ports, respectively. Each of the motor housing assemblies defines a plurality N of fluid passages (65), each of which is in fluid communication with one of said fluid volume chambers (19) defined by the gerotor gear set (13). The first fluid port (47) comprises an inlet port and the first motor housing assembly (25) and the first valve means (37) cooperate to provide first commutating fluid communication from said inlet port (47) to said expanding fluid volume chambers (19). The second fluid port (45) comprises an outlet port and the second motor housing assembly (27) and the second valve means (37) cooperate to provide second commutating fluid communication from said contracting fluid volume chambers (19) to said outlet port (45).

8 Claims, 3 Drawing Sheets

SYNCHRONIZED TRANSAXLE HYDRAULIC MOTOR

BACKGROUND OF THE DISCLOSURE

The present invention relates to rotary fluid pressure devices, and more particularly, to such devices which have two torque-transmitting output shafts, the rotations of which must be synchronized, i.e., must be maintained in a predetermined relationship to each other. In the subject embodiment, and by way of example only, the two output shafts rotate at exactly the same speed.

Although the "dual shaft" motor of the present invention could utilize various types of fluid displacement mechanisms to convert fluid pressure into torque output, the present invention is especially suited for use in a gerotor motor, and therefore, the present invention will be described in connection with a gerotor motor embodiment. Those skilled in the art will understand that as used hereinafter, the term "gerotor" means and includes both a conventional gerotor gear set and a roller gerotor, in which the teeth of the internally-toothed member comprise rollers.

Also, although the present invention may utilize various types of valving, to communicate fluid to and from the fluid displacement mechanism, it is especially advantageous for the present invention to utilize low speed, commutating valving, i.e., valving which rotates at the (low) speed of rotation of the gerotor star, as opposed to the (high) speed of orbital movement of the star. Furthermore, although the present invention may utilize various types of low speed, commutating valving, the present invention is especially adapted for use with valving of the "spool valve" type, as is now quite well known in the gerotor motor art, and the invention will be described in connection therewith.

There are many situations, or vehicle or equipment applications for gerotor motors, in which it would be desirable to provide a "special", or non-standard gerotor motor to meet certain, unique needs. An example of such a special need, and such a non-standard gerotor motor, is a dual shaft gerotor motor for use in raising and lowering a trailer "stand", either before or after the trailer is connected to, or detached from, the tractor.

Unfortunately, the engineering effort and development cost to develop such a specialized, dual shaft gerotor motor, for such a relatively low volume application as trailer stands, would typically exceed what is economically justifiable. As a result, gerotor motors have typically not been utilized in this, and a number of other, similar types of applications, for which gerotor motors are especially well-suited, but are simply not commercially available in the particular configuration required.

BRIEF SUMMARY OF THE INVENTION

Accordingly, it is an object of the present invention to provide a dual shaft gerotor motor which does not require substantial redesign of already available motor parts, and the associated product development effort and cost, and which does not require substantial new tooling.

It is a more specific object of the present invention to provide such an improved dual shaft gerotor motor which meets the above-stated object, and is able to utilize many of the parts already being produced for use in gerotor motors which are already commercially available.

It is another object of the present invention to provide a dual shaft gerotor motor which achieves the above-stated objects, and in which it is possible to achieve good lubrication and cooling of the load bearing and heat generating portions of the motor, as well as of the shaft seals, without adding any substantial or complicated structure.

It is a more specific object of the present invention to provide an improved dual shaft gerotor motor which accomplishes the preceding object for all parts of the motor by means of the conventional case flow path.

The above and other objects of the invention are accomplished by the provision of an improved dual shaft gerotor motor of the type comprising a gerotor gear set including an internally toothed ring member and an externally toothed star member, eccentrically disposed within the ring member, for orbital and rotational movement therein, the teeth of the ring and star members interengaging to defining a plurality N of expanding and contracting fluid volume chambers in response to the orbital and rotational movement. First and second motor housings are attached to first and second axially opposite ends of the gerotor gear set. First and second output shafts are rotatably supported by the first and second motor housings respectively, and first and second means for transmitting torque from the star member to the first and second output shafts, respectively, are provided. First and second valve means are operably associated with, and driven by, one of the first and second output shafts and the first and second torque transmitting means, respectively, and cooperate with the first and second motor housings, respectively, to communicate fluid to the expanding fluid volume chambers and from the contracting fluid volume chambers.

The improved dual shaft gerotor motor is characterized by the first and second motor housings being substantially identical, and defining first and second fluid ports, respectively. Each of the motor housings defines a plurality N of fluid passages, each of which is in open fluid communication with one of the fluid volume chambers. The first fluid port comprises an inlet port and the first motor housing and the first valve means cooperate to provide first commutating fluid communication from the inlet port to the expanding fluid volume chambers. The second fluid port comprises an outlet port and the second motor housing and the second valve means cooperate to provide second commutating fluid communications from the contracting fluid volume chambers to the outlet port.

DETAILED DESCRIPTION OF THE PREFERRED EMBODIMENT

Figure 1:
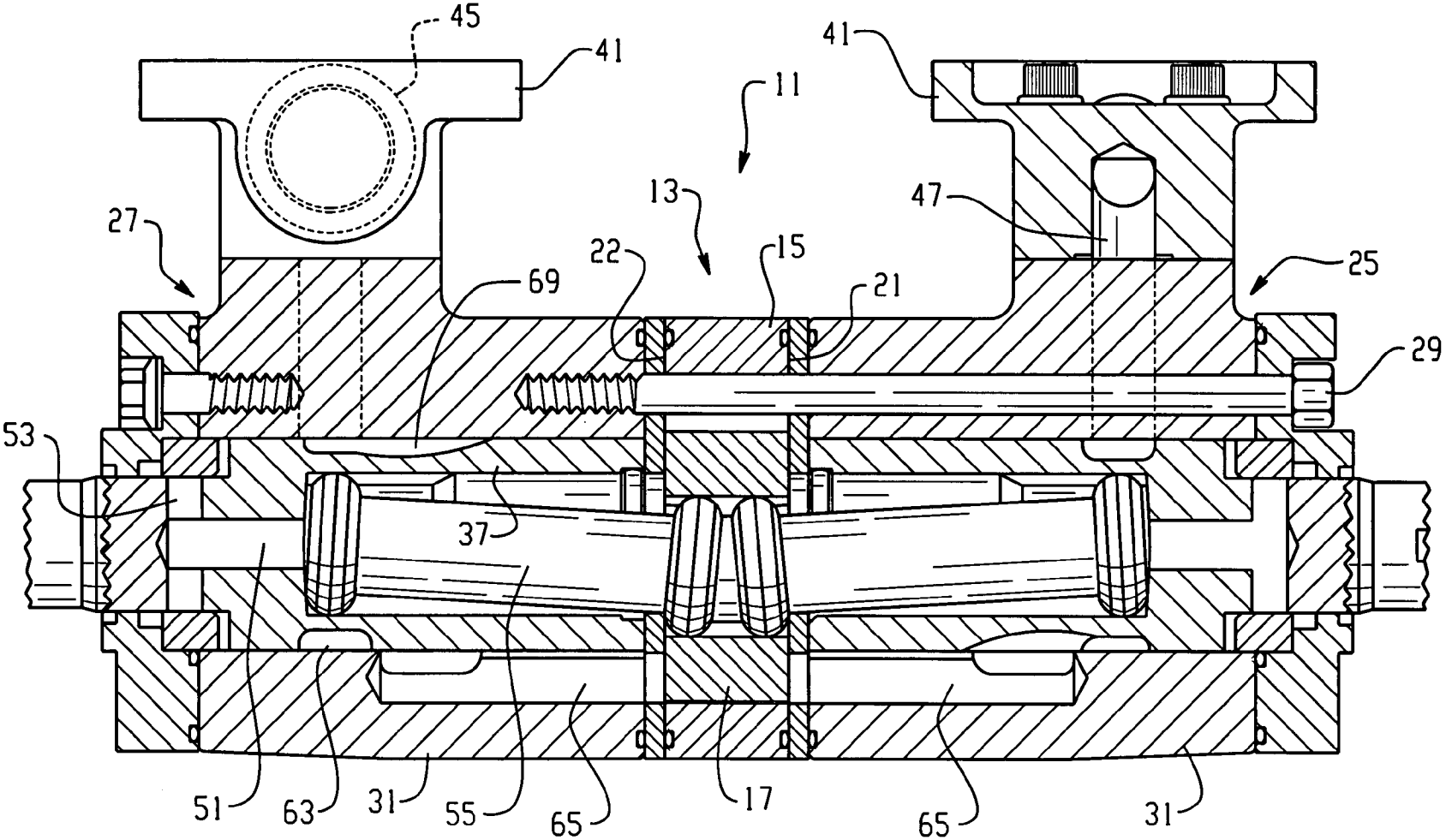
FIG. 1 is a view, mostly in axial cross-section, but partly in external plan view, of the improved dual shaft gerotor motor of the present invention.

Referring now to the drawings, which are not intended to limit the invention, FIG. 1 is a view of a dual shaft gerotor motor, made in accordance with the present invention, with FIG. 1 being primarily an axial cross-section, although one portion is shown in external plan view, as will be specifically noted and discussed hereinafter.

The dual shaft gerotor motor of the present invention, which is generally designated 11, may be generally cylindrical over much of its axial length, and comprises several distinct sections. The motor 11 comprises a fluid displacement mechanism, generally designated 13 which, in the subject embodiment, and by way of example only, comprises a gerotor gear set. The gerotor gear set 13 (also shown, and in greater detail, in FIG. 3) includes an internally toothed ring member 15, and eccentrically disposed within the ring member 15 is an externally toothed star member 17. As is well known to those skilled in the gerotor art, the ring member 15 has a plurality N of internal teeth, whereas the star member 17 has a plurality N−1 of external teeth. In the subject embodiment, and by way of example only N=7, such that the ring member 15 has seven internal teeth and the star member 17 has six external teeth.

As is also well known to those skilled in the art, as the star member 17 orbits and rotates within the ring member 15, the internal and external teeth inter-engage to define a plurality N of fluid volume chambers 19, and at any point in time, the volume chambers on one side of a "line of action" (instantaneously, a vertical line in FIG. 3) are expanding volume chambers, whereas the volume chambers on the opposite side of the line of action are contracting volume chambers. Therefore, in the gerotor gear set 13 of FIG. 3, there are a total of 7 volume chambers 19 (of which 3 are expanding, 3 are contracting, and one is in "transition").

Figure 2:
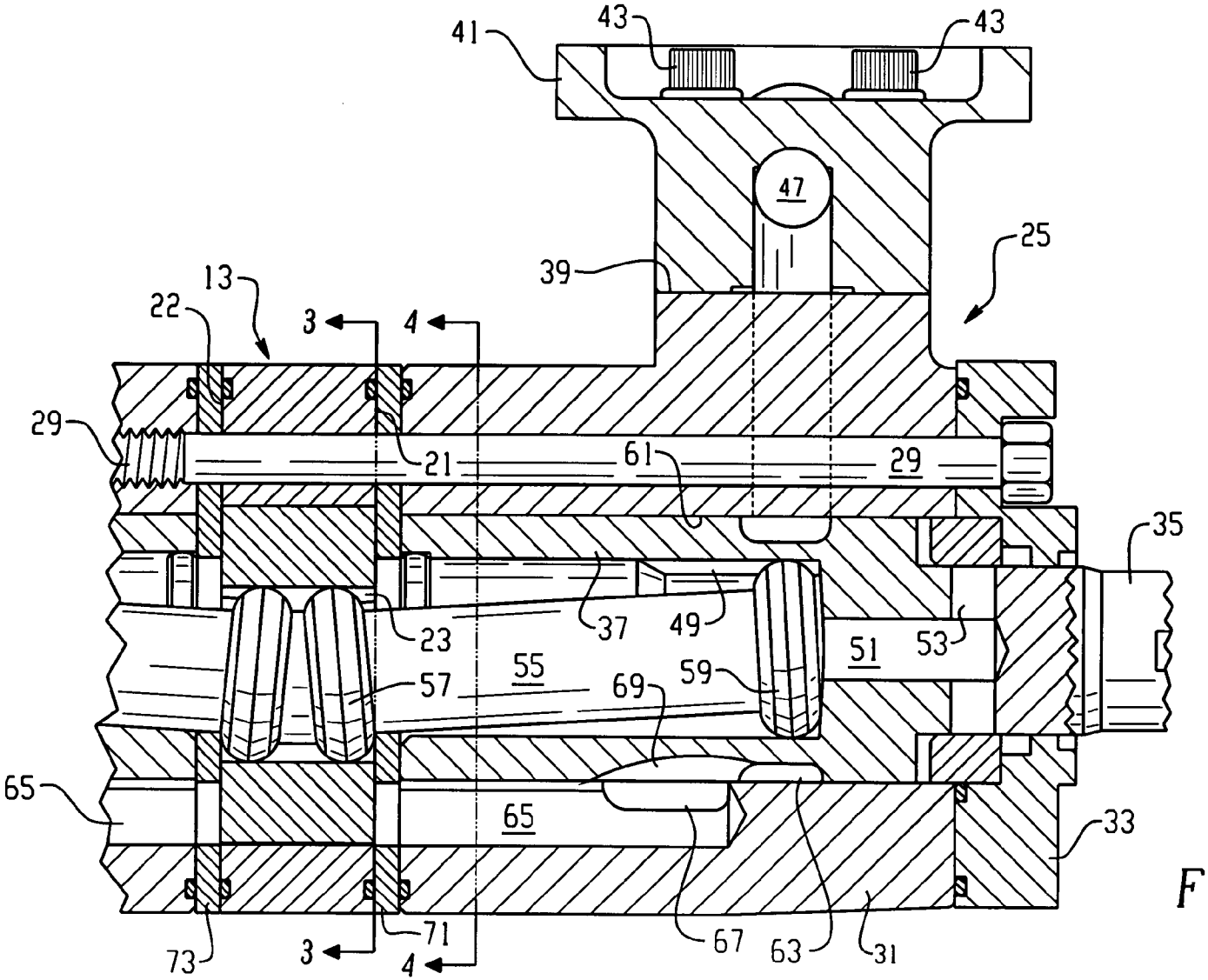
FIG. 2 is an enlarged, fragmentary axial cross-section, similar to FIG. 1, illustrating primarily the gerotor gear set, the first motor housing and first output shaft, and the first motor valving.
Figure 3:
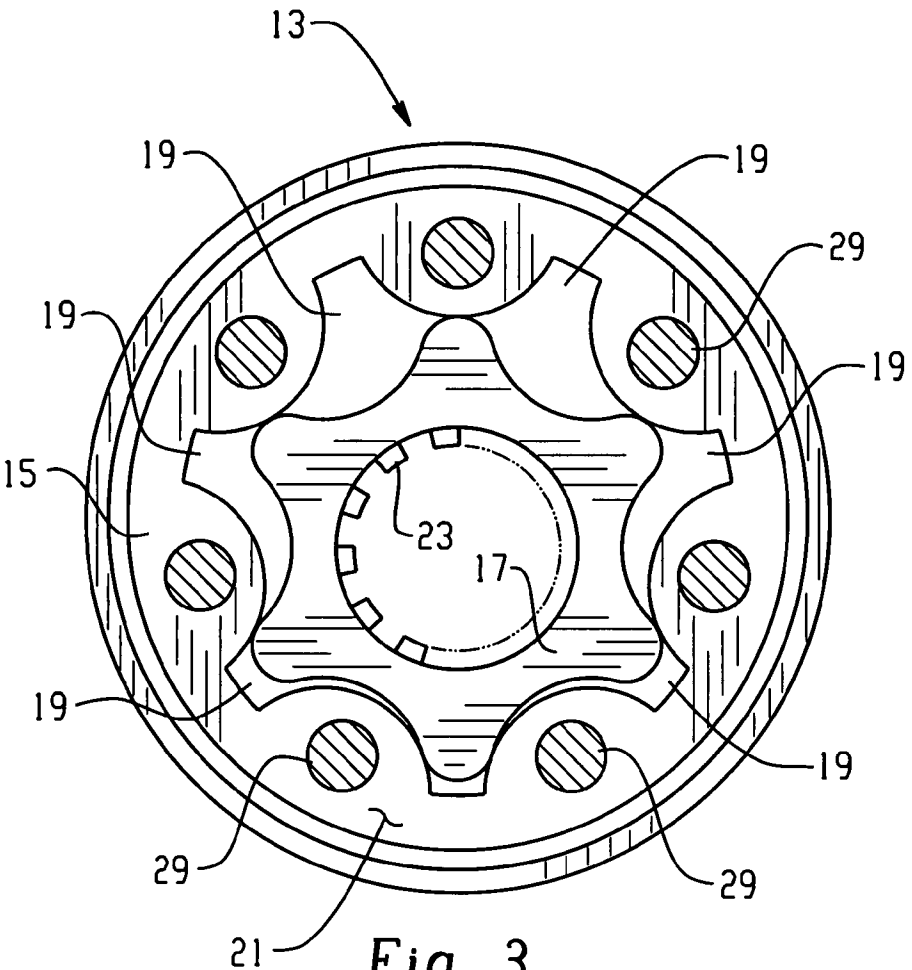
FIG. 3 is a transverse cross-section taken on lines 3—3 of FIG. 2, and on approximately the same scale.

Referring now primarily to FIGS. 2 and 3, the gerotor gear set 13 defines a first axial end 21 (see FIG. 3), and a second axial end 22 (shown in FIGS. 1 and 2), it being understood that the designations "first" and "second" in regard to the axial ends 21 and 22 have no particular physical significance, and are included only for ease of reference, as will become apparent subsequently. As is also shown in FIG. 3, the star member 17 defines a set of straight internal splines 23, the function of which will be described subsequently. In accordance with one aspect of the present invention, the gerotor gear set 13 would preferably comprise one of the gerotor gear sets already in commercial production, and being used as the fluid displacement mechanism in a conventional, one output shaft, standard gerotor motor.

Figure 4:
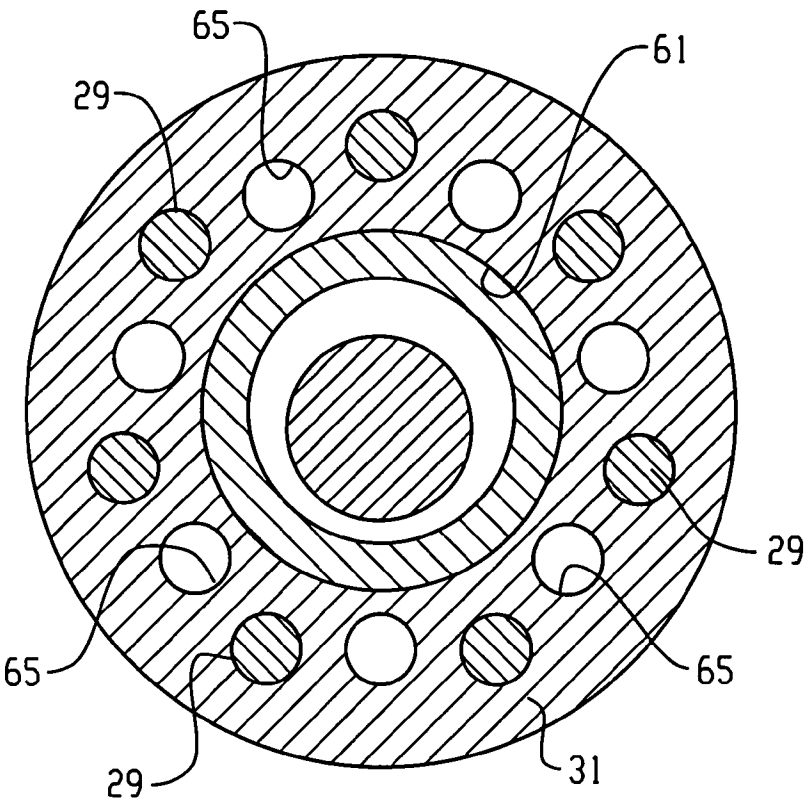
FIG. 4 is a transverse cross-section taken on line 4—4 of FIG. 2, and on approximately the same scale.

Referring again primarily to FIG. 1, and in accordance with one important aspect of the invention, attached to the first axial end 21 of the gerotor gear set 13 is a first motor housing assembly 25, and attached to the second axial end 22 of the gerotor gear set 13 is a second motor housing assembly 27. In accordance with an important aspect of the present invention, the first and second motor housing assemblies 25 and 27 are "substantially identical" as that term will be explained in greater detail hereinafter. As may best be seen in FIG. 1, one difference between the first and second motor housing assemblies 25 and 27 is that the assemblies 25 and 27 are held together in tight sealing engagement with the gerotor gear set 13 by means of a plurality of bolts 29, only one of which is shown in each of FIGS. 1 and 2, but all of which are shown in transverse cross-section in FIGS. 3 and 4. In the subject embodiment, and by way of example only, bolt holes are drilled (or formed in some other suitable manner) through the entire axial extent of the first motor housing assembly 25, whereas the second motor housing assembly 27 is provided with only a relatively short bolt hole (immediately adjacent the gerotor gear set 13), most of which is internally threaded to receive, in threaded engagement therewith, the bolts 29 as shown in FIG. 1.

Referring now primarily to FIG. 2, the first motor housing assembly 25 will be described in somewhat more detail, recognizing that the second motor housing assembly 27 does comprise, or may comprise, components which are substantially identical to those in the first motor housing assembly 25, except as has been noted in regard to the bolts 29, and the bolt holes therefore, and as may be noted hereinafter. Even in regard to the difference between the bolt holes in the motor housing assemblies 25 and 27, it should be noted that the manufacturing process may still start with identical housing castings, and then form internal threads in one casting, and drill all the way through the other casting as shown, all of which is well within the ability of those skilled in the art to understand and to implement. Therefore, the motor housings, as shown and described herein, by way of example only, are considered "substantially identical", as that term is used herein and in the appended claims.

The first motor housing assembly 25 includes a motor housing 31, and attached (by the bolts 29) to a forward end of the housing 31 is a flange member 33, of the general type which is already in use on commercially available gerotor motors. The motor housing 31 and flange member 33 together rotatably support an output shaft 35 (shown only fragmentarily in FIGS. 1 and 2), and in the subject embodiment, there is, formed integrally with the output shaft 35, a spool valve member 37, which will be described in greater detail subsequently. The part comprising the output shaft 35 and the spool valve member 37 may literally start out as the same output shaft member as is now used in commercially available spool valve gerotor motors, except as will be noted hereinafter.

The housing 31 defines a port face 39, and in a conventional gerotor motor, it is at the port face that an inlet port and an outlet port would normally be formed, and adapted to receive appropriate threaded fittings, etc. However, in accordance with one aspect of the present invention, attached to the port face 39 is a mounting member 41, it being understood that one function of the mounting members 41 is to facilitate mounting of the motor 11 to its associated structure. Referring again to FIG. 1, it should be understood that the two mounting members 41 are preferably identical, but are shown in FIG. 1 on different planes to facilitate a more thorough description. The mounting member 41 associated with the first motor housing assembly 25 is shown in axial cross-section in FIGS. 1 and 2, wherein it may be seen that the mounting member 41 is attached to the port face 39 by means of a pair of bolts 43 (only the heads of which are visible), the bolts 43 extending down into internally threaded portions (not shown) formed in the motor housing 31. Each of the mounting members 41 includes what may be a conventional, internally threaded port, represented by concentric, dashed circles, designated 45 (shown in only the mounting member 41 associated with the second motor housing assembly 27) in FIG. 1, the port 45 being in fluid communication with a fluid passage 47 defined within the mounting member 41.

It should be understood that, in accordance with a preferred form of the present invention, there is only a single port 45 associated with each of the motor housing assemblies 25 and 27, as opposed to a conventional housing assembly for a gerotor motor which defines both an inlet port and an outlet port. Therefore, the fluid passage 47 shown in FIG. 2 will, for purposes of subsequent description, be considered, and identified as, the inlet port, connected to a source of high pressure, while the port 45 shown in FIG. 1 will be considered, and identified as, the outlet port, connected to the fluid reservoir or some other relatively lower pressure portion of the circuit (which could even be a downstream inlet port of another motor in series). As is well known to those skilled in the art, reversing the connections to the inlet port 47 and outlet port 45 will reverse the direction of rotation of the output shafts 35.

Referring again primarily to FIG. 2, the output shaft 35 and the spool valve member 37 cooperate to define a set of straight, internal splines 49, and adjacent thereto, an axially extending bore 51, which is in fluid communication with a pair of radially extending bores 53, the function of the bores 51 and 53 to be described subsequently. In a manner well known to those skilled in the gerotor motor art, the first motor housing assembly 25 includes a main drive shaft 55 (also referred to in the art as a "dog-bone" shaft). Preferably, the drive shaft 55 includes, at its opposite, axial ends, a set of crowned external splines 57, in engagement with the internal splines 23, and a set of crowned external splines 59, in engagement with the internal splines 49. Thus, orbital and rotational movement of the star member 17 is transmitted, by the drive shaft 55, into purely rotational motion of the output shaft 35, in a manner well known to those skilled in the art.

The motor housing 31 defines a spool bore 61 (see also FIG. 4), and the spool valve member 37 defines an annular fluid groove 63 in continuous fluid communication with the fluid inlet port (the fluid passage 47, as described previously). In communication with each of the fluid volume chambers 19 is an axial fluid passage 65 defined by the housing 31. Each axial passage 65 communicates with the spool bore 61 by means of a slot 67 which, typically, is milled during the machining of the housing 31. The spool valve member 37 defines a plurality of axial slots 69 each of which is in open fluid communication with the annular fluid groove 63, and is positioned to engage in commutating fluid communication with the slots 67, in a manner well known to those skilled in the gerotor motor art. However, as may best be seen in FIG. 2, the first motor housing assembly 25 defines only a single annular fluid groove 63 (rather than two, as in a standard gerotor motor), and furthermore, defines only a single set of axial slots 69 (rather than two, as in a standard gerotor motor).

The same is true within the second motor housing assembly 27, such that, in accordance with one aspect of the invention, the dual shaft gerotor motor 11 utilizes what may be referred to as "split valving", wherein the first motor housing assembly 25 provides first commutating fluid communication from the inlet port 47 to the expanding volume chambers 19, and the second motor housing assembly 27 provides second commutating fluid communication from the contracting volume chambers 19 to the outlet port 45. The "split valving" arrangement of the present invention (i.e., first valving in assembly 25 and second valving in assembly 27) results in an overall pressure differential from one axial end of the motor (at the inlet port 47) to the other axial end of the motor (at the outlet port 45). This pressure differential from the one (first) end to the other (second) end greatly facilitates lubrication of the various parts of the motor, without the need for additional structure. For example, the pressure differential from the one end to the other makes it possible to lubricate and cool the seals in each motor housing assembly, and to lubricate and cool the spline connections 49,59 and 23,57 in series in the first motor housing assembly 25, then the corresponding spline connections 23,57 and 49,59 in series (and in that order) in the second motor housing assembly 27, and to do so without modifying any of the structure of either motor housing assembly 25 or 27 from what is in commercial usage, except where noted previously.

In the actual manufacture of dual shaft motors 11, in accordance with the present invention, it would be preferable to provide the same basic forged or cast output shaft and spool valve member for the motor 11 as for the conventional gerotor motors, then machine the annular fluid groove 63 and the axial slots 69 on all parts, and then, only for those parts to be used in the conventional motors, machine the other annular fluid groove and the other set of axial slots, while removing from the machining process those parts to be used in the dual shaft motors 11 of the present invention.

It will be understood by those skilled in the art of gerotor motors that, if the first and second motor housing assemblies 25 and 27 were literally manufactured to be identical, and were then assembled to the gerotor gear set 13 in that condition, the result would be that the axial passages 65 of each of the first and second motor housing assemblies 25 and 27 would, at any given instant in time, be in fluid communication with the same fluid volume chambers 19, such that the flow path from the inlet port 47 to the outlet port 45 would effectively comprise a "short circuit" through the gerotor gear set 13. Therefore, although preferably, the first and second motor housing assemblies 25 and 27 are manufactured to be substantially identical (except for the bolt holes and bolts 29 as discussed previously), those skilled in the art will understand that, in accordance with the invention, it is necessary, after manufacture of the motor housing assemblies 25 and 27, to "offset" the two spool valve members 37, relative to each other. The amount of offset is related to the number of internal teeth N of the ring member 15 and the number of external teeth N−1 of the star member 17, and is determine by the following relationship:

$$\text{Offset (in degrees)}=360/[2\times(N-1)];$$

Therefore, in the subject embodiment, and by way of example only, the Offset would be 360/[2×6]=30 degrees. Those skilled in the art will understand that the offset could also comprise, in the subject embodiment, 90 degrees or 150 degrees, or 210 degrees, etc., or any multiple of the spacing between adjacent axial slots 69.

One of the advantages of the split valving arrangement illustrated and described herein is the improved lubrication and cooling which results, as mentioned previously. As may best be seen in FIG. 1, as high pressure fluid flows in through the inlet port 47, most of the flow volume passes through the annular fluid groove 63 (the "main flow path"), but in parallel therewith, a certain amount of the total flow passes through the space between the spool bore 61 and the spool valve member 37 of the first motor housing assembly 25 (i.e., the space to the right of the groove 63 in FIG. 2). This parallel lubrication flow then passes through the radially-extending bores 53, then the axially-extending bore 51, then through the interior of the spool valve member 37, and through the interior of the star member 17. This lubrication flow through the interior of the star member 17 is "joined" by any leakage fluid flowing radially inward along either the first axial end 21 or the second axial end 22 of the gerotor gear set 13 (i.e., along the end faces of the star member 17). Thereafter, the total lubrication flow then passes through the interior of the spool valve member 37 of the second motor housing assembly 27, then passes through the axially-extending bore 51 and the radially-extending bores 53 of the assembly 27, then into the annular fluid groove 63 of the assembly 27, where the lubrication flow re-combines with the main flow path through the gerotor 13, and the total flow then passes to the outlet port 45.

The above-described lubrication flow path, driven by the inherent pressure differential which exists when the motor 11 is operating, insures effective lubrication of all four of the spline connections, in series, such that any contamination particles are removed from the spline connections and from the motor. In addition, all of the various sealing and bearing surfaces are effectively lubricated to optimize the performance of the motor and prolong the useful life of the motor.

As is well known to those skilled in the gerotor motor art, there are provided on axially opposite ends of the gerotor gear set 13, a pair of wear plates 71 and 73, of the type commonly used in gerotor motors. The wear plates 71 and 73 protect the motor housings 31 from wear as the star 17 orbits and rotates within the stationary ring member 15. For purposes of the present invention, and the explanation thereof, as well as for purposes of the appended claims, the wear plates 71 and 73 (or any other similar or equivalent structure) will be considered to be part of the motor housing assemblies 25 and 27, respectively.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. A dual shaft gerotor motor of the type comprising a gerotor gear set including an internally-toothed ring member and an externally-toothed star member eccentrically disposed within said ring member for orbital and rotational movement therein, the teeth of said members interengaging to define a plurality N of expanding and contracting fluid volume chambers in response to said orbital and rotational movement; first and second motor housing assemblies attached to first and second axially opposite ends of said gerotor gear set; first and second output shafts rotatably supported by said first and second motor housing assemblies, respectively, and first and second means for transmitting torque from said star member to said first and second output shafts, respectively; first and second valve means, operably associated with, and driven by, one of said first and second output shafts and said first and second torque transmitting means, respectively, and cooperating with said first and second motor housing assemblies, respectively, to communicate fluid to said expanding fluid volume chambers, and from said contracting fluid volume chambers; characterized by:

(a) said first and second motor housing assemblies being substantially identical, and defining first and second fluid ports, respectively;

(b) each of said motor housing assemblies defining a plurality N of fluid passages, each of which is in fluid communication with one of said fluid volume chambers;

(c) said first fluid port comprising an inlet port and said first motor housing assembly and said first valve means cooperating to provide first commutating fluid communication from said inlet port to said expanding fluid volume chambers;

(d) said second fluid port comprising an outlet port and said second motor housing assembly and said second valve means cooperating to provide second commutating fluid communication from said contracting fluid volume chambers to said outlet port; and (e) said motor defining a main flow path from said fluid port through said fluid volume chambers to said second fluid port, said motor further defining a lubrication fluid path, in parallel with said main flow path, said lubrication fluid path flowing along said first torgue transmitting means, then through a central opening defined by said star member of said gerotor gear set, then along said second torque transmitting means.

2. A dual shaft gerotor motor as claimed in claim 1, characterized by said first and second motor housing assemblies including first and second mounting members, respectively, by which said gerotor motor is adapted to be mounted relative to its associated structure.

3. A dual shaft gerotor motor as claimed in claim 2, characterized by said first and second mounting members being substantially identical, and defining said first and second) fluid ports, respectively.

4. A dual shaft gerotor motor as claimed in claim 1, characterized by said first and second output shafts being substantially identical, and said first and second torque transmitting means being substantially identical.

5. A dual shaft gerotor motor as claimed in claim 4, characterized by said first and second valve means being substantially identical.

6. A dual shaft gerotor motor as claimed in claim 1, characterized by said first motor housing assembly and said first valve means cooperating to define a first annular fluid chamber in fluid communication with said first fluid port and said first valve means defining first timing passages cooperating with said plurality N of said fluid passages to provide said first commutating fluid communication.

7. A dual shaft gerotor motor as claimed in claim 6, characterized by said second motor housing assembly and said second valve means cooperating to define a second annular fluid chamber in fluid communication with said second fluid port and said second valve means defining second timing passages cooperating with said plurality N of said fluid passages to provide said second commutating fluid communication.

8. A dual shaft gerotor motor as claimed in claim 7, characterized by an assembly of said first motor housing assembly, said first valve means and said first torque transmitting means being substantially identical to, and interchangeable with, an assembly of said second motor housing assembly, said second valve means, and said second torque transmitting means.

* * * * *